US006647678B1

(12) United States Patent
Zambelli et al.

(10) Patent No.: US 6,647,678 B1
(45) Date of Patent: Nov. 18, 2003

(54) DEVICE FOR CONNECTING PREFABRICATED BEAMS TO PILLARS OR SIMILAR LOAD-BEARING STRUCTURAL ELEMENTS

(76) Inventors: Sergio Zambelli, Via Stezzano 28, 24050 Zanica (IT); Benito Zambelli, Via Roma 44, 24050 Zanica (IT)

( * ) Notice: Subject to any disclaimer, the term of this patent is extended or adjusted under 35 U.S.C. 154(b) by 0 days.

(21) Appl. No.: 09/669,970

(22) Filed: Sep. 26, 2000

(30) Foreign Application Priority Data

Oct. 12, 1999 (IT) ..... MI99A2129

(51) Int. Cl.[7] ..... E04B 1/04

(52) U.S. Cl. ..... 52/252; 52/167.3; 52/223.9; 52/223.11; 52/223.14

(58) Field of Search ..... 52/167.1, 167.3, 52/231, 223.4, 223.6, 223.7, 223.9, 223.11, 223.14, 414, 252, 284, 127.2

(56) References Cited

U.S. PATENT DOCUMENTS 4,819,394 A * 4/1989 Compton ..... 52/252
4,878,327 A * 11/1989 Nutzel et al. ..... 52/230
6,065,257 A * 5/2000 Nacey et al. ..... 52/223.8
6,155,019 A * 12/2000 Ashton et al. ..... 52/739.1

FOREIGN PATENT DOCUMENTS

GB 836 779 6/1960

* cited by examiner

*Primary Examiner*—Carl D. Friedman
*Assistant Examiner*—Yvonne M. Horton
(74) *Attorney, Agent, or Firm*—Guido Modiano; Albert Josif; Daniel O'Byrne

(57) ABSTRACT

A device for connecting a beam to pillars, or similar load-bearing structural elements, for constructing buildings, particularly multi-story buildings, by way of prefabricated concrete components. The device comprises a first connection for connecting the two end regions of the beam to the pillars and a second connection for connecting two intermediate regions of the longitudinal extension of the beam to the pillars. The first connection is constituted by connection elements of the interlocking type and the second connection comprises at least two rigid inclined ties, each of which connects an intermediate region of the beam to a region of the respective pillar which lies at a higher level than the region where the tie is coupled to the beam.

52 Claims, 6 Drawing Sheets

DEVICE FOR CONNECTING PREFABRICATED BEAMS TO PILLARS OR SIMILAR LOAD-BEARING STRUCTURAL ELEMENTS

BACKGROUND OF THE INVENTION

The present invention relates to a device for connecting a beam to pillars, or similar load-bearing structural elements, for constructing buildings, particularly multi-story buildings, by means of prefabricated concrete components.

In recent years the construction technique that uses prefabricated concrete components has become increasingly widespread, mainly owing to its short completion times with respect to the conventional method of on-site building.

However, in some particular fields the prefabrication technique has been unable to grow fully.

One of these fields is the construction of office or residential buildings, particularly of the multi-story type.

Prefabricated concrete components are in fact currently scarcely applied in this field because prefabricated beams, in order to be able to withstand the loads to which they are subjected, by being coupled to the pillar simply by resting thereon at their ends, have excessively large vertical dimensions.

On-site building is able to minimize the height of the beams in that this construction technique provides uninterrupted continuity between the pillar and the beam.

Prefabrication instead entails, for the various parts that compose the building, a momentary discontinuity which is eliminated only with final assembly. This fact, however, inevitably forces prefabricated beams, as mentioned, to have larger vertical dimensions than beams built on-site.

The prefabrication technique has attempted to solve this drawback by using prestress, which consists in loading the beam by prestressing it so that it bends upward. However, this solution is advantageous with considerable spans, i.e., pillar distances, otherwise the resulting saving in height of the beam, and therefore the cost saving, are negligible.

However, it should be noted that the prefabrication technique allows remarkable speed of construction, in addition to industrial-style production and quality control; moreover, the prefabrication technique allows to build regardless of weather conditions, which can instead heavily affect on-site building, and allows the progress of work to be independent of the curing of the concrete, which greatly slows the construction of multi-story buildings with the conventional technique of on-site building.

In view of the undeniable advantages offered by the prefabrication technique, the need is felt to be able to extend its application also to those fields which, owing to the above described reasons, have as yet been unable to adopt this technique.

SUMMARY OF THE INVENTION

The aim of the present invention is to provide a device for connecting a beam to pillars, or similar load-bearing structural elements, for constructing buildings, particularly multi-story buildings, by means of prefabricated concrete components which allows to reduce the height of the beam, although it is prefabricated, without necessarily having to prestress said beam.

Within the scope of this aim, an object of the invention is to provide a device which does not increase the space occupation of the beam and pillars.

Another object of the invention is to provide a device which allows to advantageously use the prefabrication technique in buildings, including multi-story ones, with beams which are significantly shorter than those usually used in industrial construction work.

Another object of the invention is to provide a device which provides a beam-pillar connection which has excellent earthquake resistance.

These and other objects which will become better apparent hereinafter are achieved by a device for connecting a beam to pillars, or similar load-bearing bearing structural elements, for constructing buildings, particularly multi-story buildings, by way of prefabricated concrete components, characterized in that it comprises first means for connecting the two end regions of the beam to the pillars and second means for connecting two intermediate regions of the longitudinal extension of the beam to the pillars, said first connection means being constituted by connection means of the interlocking type and said second connection means comprising at least two rigid inclined ties, each of which connects an intermediate region of the beam to a region of the respective pillar which lies at a higher level than the region where the tie is coupled to the beam.

BRIEF DESCRIPTION OF THE DRAWINGS

Further characteristics and advantages of the invention will become better apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
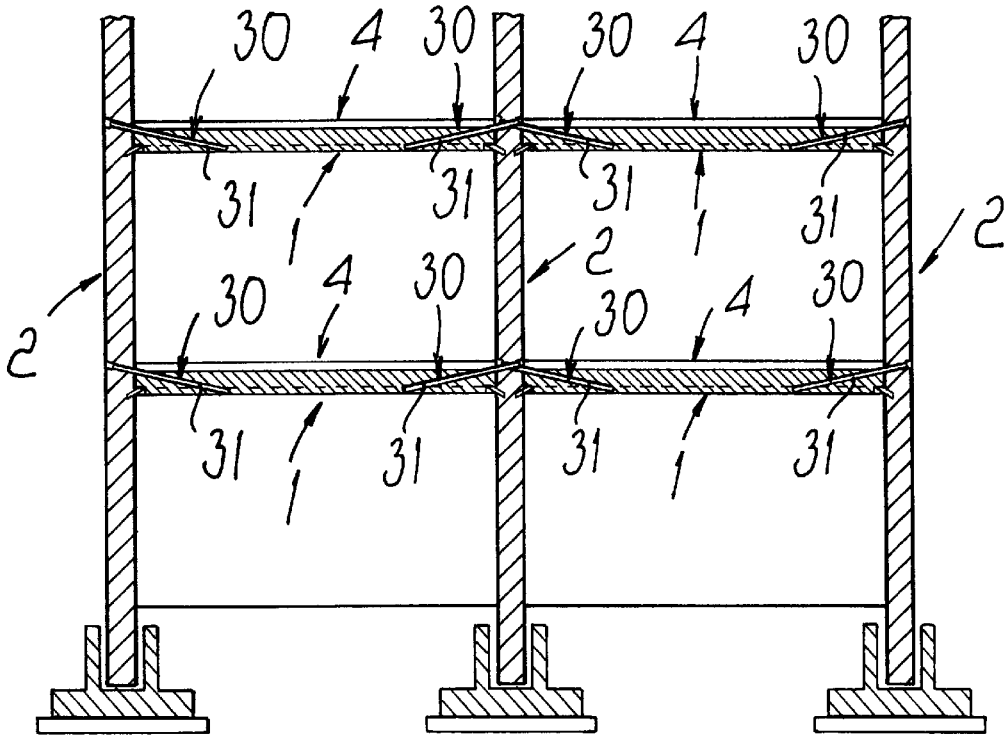
FIG. 1 is a schematic sectional view, taken along a vertical plane, of the structure of a building with pillars and beams mutually connected by way of the device according to the invention.
Figure 2:
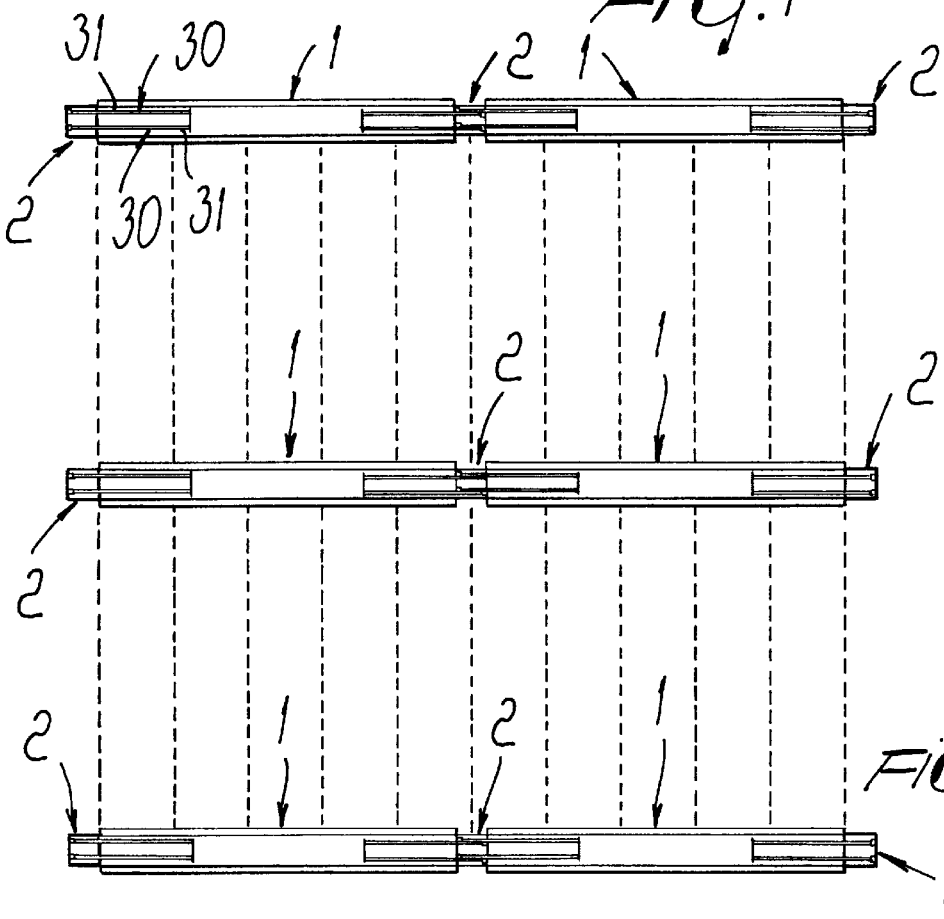
FIG. 2 is a schematic top plan view of the structure of FIG. 1.
Figure 3:
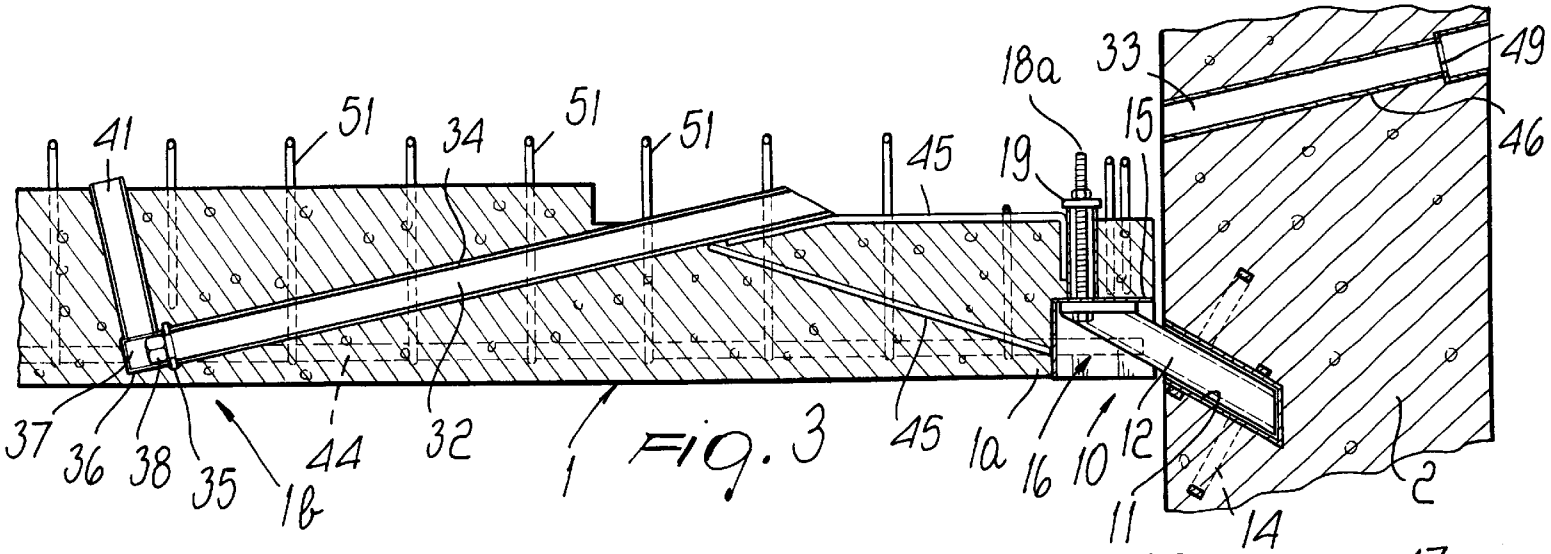
FIG. 3 is a sectional view, taken along a vertical line, of the connection between a beam and a pillar, provided by way of the device according to the invention, in an intermediate step of assembly.
Figure 4:
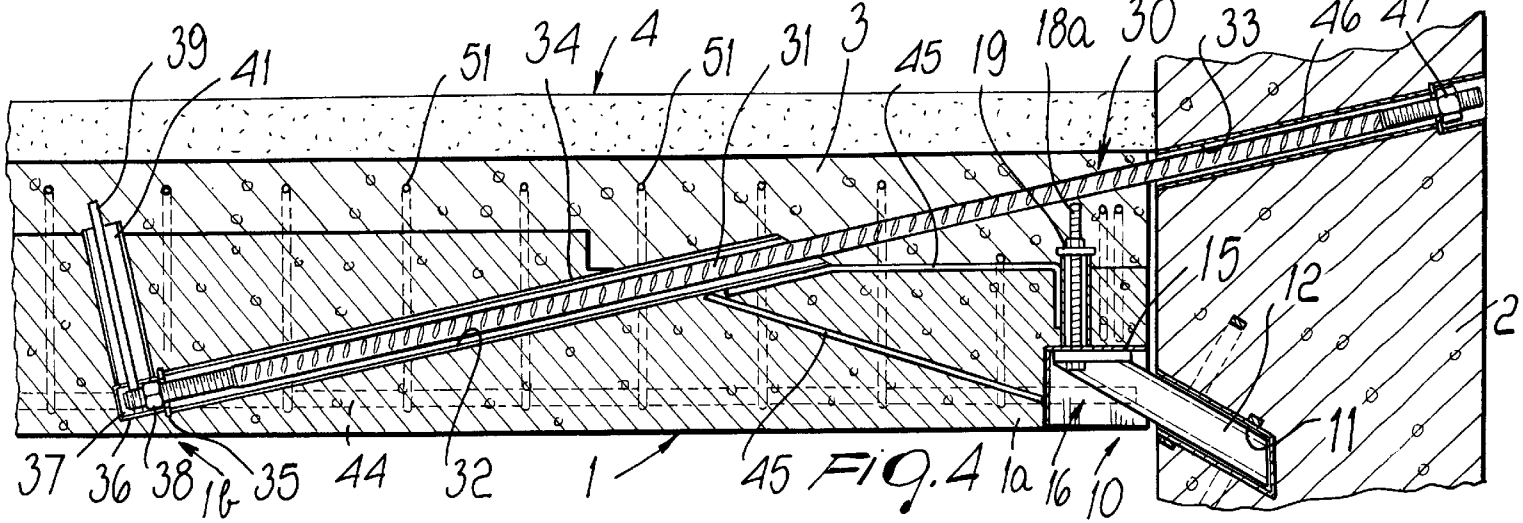
FIG. 4 is a sectional view, taken along a vertical line, of the connection between a beam and a pillar, performed by way of the device according to the invention, after assembly has been completed.

With reference to the figures, the device according to the invention comprises first means 10 for connecting the two end regions 1*a* of a beam 1 to the pillars 2 that must support the beam, and second means 30 for connecting two intermediate regions 1*b* of the longitudinal extension of the beam 1 to the pillars 2.

The first connecting means 10 are constituted by connecting means of the interlocking type, and the second connecting means 30 comprise at least two rigid inclined ties 31, each of which connects an intermediate region 1*b* of the beam 1 to a region of the respective pillar 2 that lies at a higher level than the region where the tie 31 is coupled to the beam 1.

The device according to the invention further comprises means for tensioning, by the selected amount, the ties 31 so as to preload the beam 1, as will become apparent hereinafter.

Conveniently, the regions where the ties 31 are coupled to the beam 1 and to the pillars 2 are arranged so that the portion of the ties 31 that runs from the beam to the pillars 2 can be easily embedded in the thickness of the slab 3 or other concrete element which will be cast over the beam 1, or otherwise embedded in the floor 4, so that at the end of the construction work the ties 31 are perfectly concealed.

For the sake of simplicity in description, the first connecting means 10 and the second connecting means 30 will be described with reference to the connection of a beam 1 to one pillar 2, it being understood that the connection of the beam 1 to the other pillar 2 that supports it is performed with similar connecting means.

The first connecting means 10 comprise a cavity 11 which is formed in the body of the pillar 2 and is open on the side of the pillar 2 that is directed toward the beam 1. The cavity 11 accommodates a bracket 12 which protrudes from the side of the pillar 2 that is directed toward the beam 1 and is fixed to the end region 1*a* of the beam 1.

The cavity 11 is formed by a box-like body 13 which is embedded in the concrete casting that constitutes the pillar 2 during its production.

The box-like body 13 can be constituted, for example, by a tubular steel body which is open at one of its ends, which is arranged flush with the side of the pillar 2 that is designed to be directed toward the beam 1. Stirrups 14 can be provided on the outer surface of the box-like body 13 in order to increase its anchoring in the pillar 2.

The bracket 12 also can be constituted by a steel component which is inserted in the cavity 11 so that one of its ends protrudes from the side of the pillar 2 that is directed toward the beam 1. Said end of the bracket 12 forms a support for the end region 1*a* of the beam 1 and is rigidly fixed to the beam 1 in order to provide a connection of the interlocking type between the beam 1 and the pillar 2.

The bracket 12 can have a body provided with a tubular structure, with a transverse cross-section which is complementary to the cross-section of the cavity 11 and is preferably rectangular or square.

Advantageously, the cavity 11 and the bracket 12 are inclined upwardly toward the beam 1 to achieve greater stability in the resting of the beam 1 on the bracket 12.

The bracket 12 can be fixed to the beam 1 by bolting.

More particularly, the end 1*a* of the beam 1 is preferably provided by means of a shaped plate 15, made for example of steel, which is firmly anchored to the concrete casting that constitutes the beam 1 and defines, on the lower side of the end 1*a* of the beam 1, a recess 16 in which the bracket 12 engages.

Two bushes 17*a* and 17*b* are welded to the plate 15, at two holes provided for this purpose, and define two passages which extend from the recess 16 up to the upper side of the beam 1 and through which the screws 18*a* and 18*b*, used to bolt the end 1*a* of the beam 1 to the bracket 12, pass. Bolting is completed by means of a contrast plate 19 which has holes at the screws 18*a* and 18*b* and is rested on the upper side of the beam 1 at the bushes 17*a* and 17*b* and by means of nuts 20*a* and 20*b* which are tightened onto the screws 18*a* and 18*b* that pass through said contrast plate 19.

In the beam 1 there is a passage 32 for the tie 31, so as to arrange the region where the tie 31 couples to the beam 1 proximate to the lower side of the beam 1.

A passage 33 for the tie 31 is also provided in the pillar 2, in a region located above the supporting plane formed by the bracket 12, in order to arrange the coupling region of the tie 31 proximate to the slide of the pillar 2 that lies opposite the side directed toward the beam 1.

The passage 32 is formed by a tubular body 34 which is embedded in the body of the beam 1. One end of the tubular body 34 is open at the upper face of the beam 1, while the other end is located inside the body of the beam 1.

The tubular body 34 is preferably made of steel, and its end arranged inside the beam 1 is fixed, for example by welding, to a face of a plate 35 provided with a hole at the tubular body 34 in order to allow the passage of the tie 31.

A box-like element 36 is fixed on the other face of the plate 35 so as to form a seat 37 for the end of the tie 31.

Inside the tubular body 34, or in the plate 35, there is provided a threaded seat which can be engaged by the end of the tie 31, which is appropriately threaded. In the illustrated embodiment, said threaded seat is constituted by the female thread of a nut 38 which is welded to the plate 35 inside the seat 37.

Conveniently, the fixing of the tie 31 to the beam 1 provided by means of the coupling of its threaded end to the female thread of the nut 38 can be reinforced by means of a pin 39 which is inserted in a through hole which passes through the end of the tie 31 that protrudes from the nut 38 inside the seat 37.

The pin 39 is accommodated in a tubular body 41 which is embedded in the body of the beam 1. The tubular body 41, which is preferably made of steel, is welded with one of its ends to the box-like element 36 and extends inside the beam 1 so that its opposite end lies at the upper side of the beam 1. The tubular body 41 is conveniently perpendicular to the tubular body 34 in order to allow the pin 39 to enter the tie 31 at right angles.

A slot 43, instead of a circular opening, for the passage of the pin 39 can be provided at the region where the tubular body 41 is connected to the box-like element 36.

It should be noted that the plate 35 has a plurality of holes for the passage of the longitudinal bars 44 of the reinforcement frame of the beam 1.

The tubular body 34 is further rigidly connected, for example by means of bars 45 whereto is welded, to the plate 15, which is also welded to the bars 45.

In this manner, the assembly formed by the plate 15, the tubular body 34, the tubular body 41 and the box-like element 36 constitutes a monolithic structure which is embedded inside the beam 1 during its production, achieving a precision in the positioning of these elements inside the beam 1 which allows to insert and lock the tie 31 in the beam 1 very simply and rapidly. Said monolithic structure is further connected to the reinforcement frame of the beam 1 and cooperates with it in increasing the strength of the beam 1.

The passage 33 is formed by an additional tubular body 46, preferably made of steel, which is embedded in the pillar 2 during its production.

The tubular body 46 has an end which lies flush with the side of the pillar 2 that is directed toward the beam 1 and another end which lies flush with the opposite side of the pillar 2 with respect to the beam 1. The tubular body 46 has, proximate to this end, a larger diameter so as to form an abutment for a nut 47 which is screwed onto the threaded end of the tie 31 that lies opposite the one inserted in the beam 1, in order to fix the tie 31 to the pillar 2 and tension said tie 31.

At the change in diameter of the tubular body 46, inside said tubular body 46, it is possible to weld an end plate 48 which is crossed by a slot 49 to allow the passage of the tie 31.

Conveniently, the tubular body 46 can be rigidly connected, by means of a bent bar 50 to which it is welded, to the box-like body 13, for example by welding the bar 50 to one of the stirrups 14.

The tubular body 46, the bar 50 and the box-like body 13 constitute a monolithic structure which is embedded in the pillar 2, achieving good precision in the positioning of the tubular body 46 with respect to the cavity 11 for the bracket 12, thus facilitating the mutual assembly of the beam 1 and the pillar 2 and the insertion of the tie 31 in the pillar 2 and in the beam 1.

The passage 32 and the passage 33 are conveniently inclined with respect to the horizontal with an angle which depends on the intended position of the coupling points of the tie 31 on the beam 1 and on the pillar 2.

It should be noted that according to design requirements and to the strength required for the beam 1, it is possible to provide, instead of a single tie 31, two ties 31 arranged side by side, as shown, or a plurality of ties 31. In this case, a plurality of tubular bodies 34 and 41 are provided in the beam 1 and a plurality of tubular bodies 46 are provided in the pillar 2.

Figure 5:
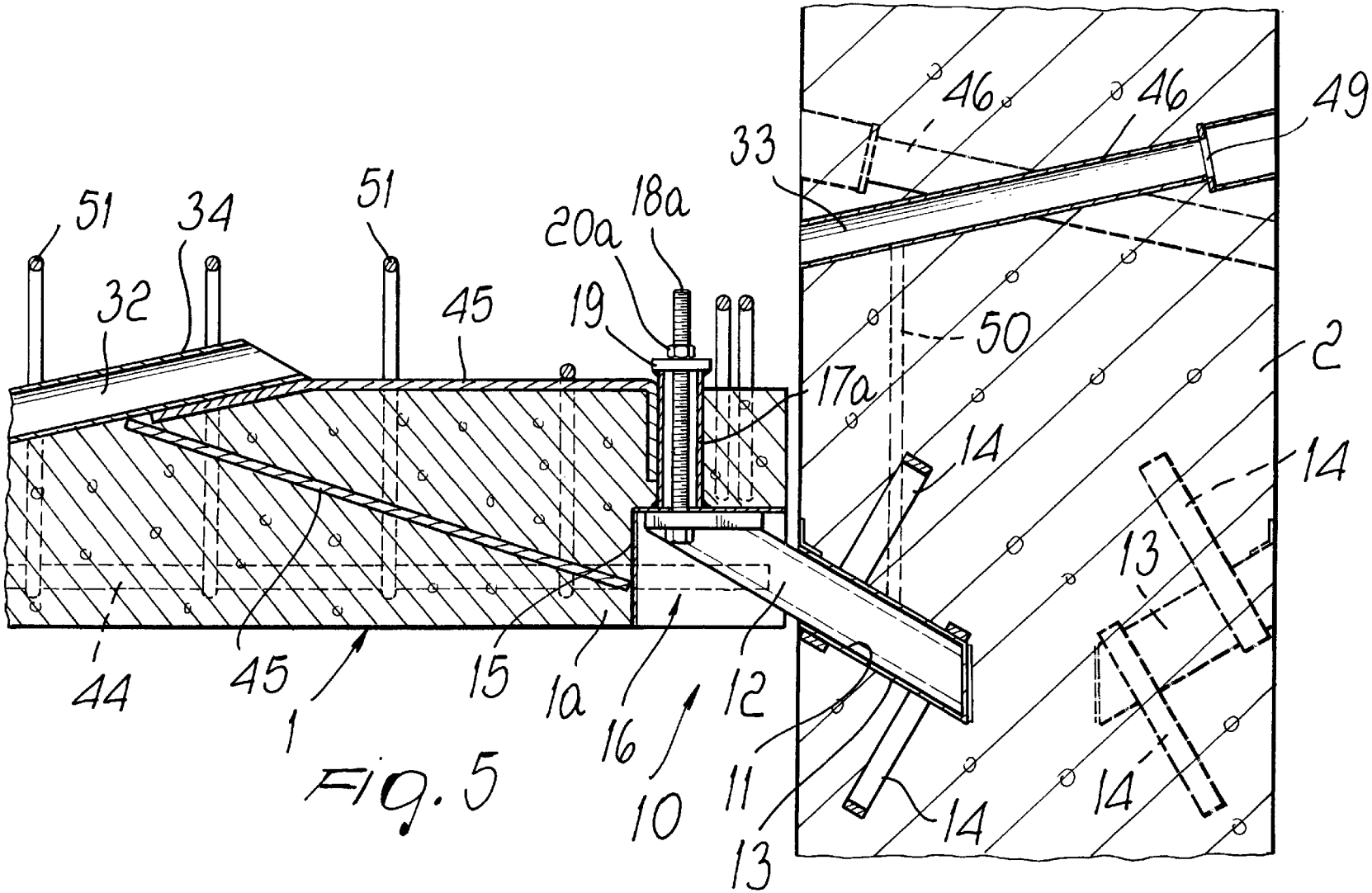
FIG. 5 is an enlarged-scale view of a detail of FIG. 3.
Figure 6:
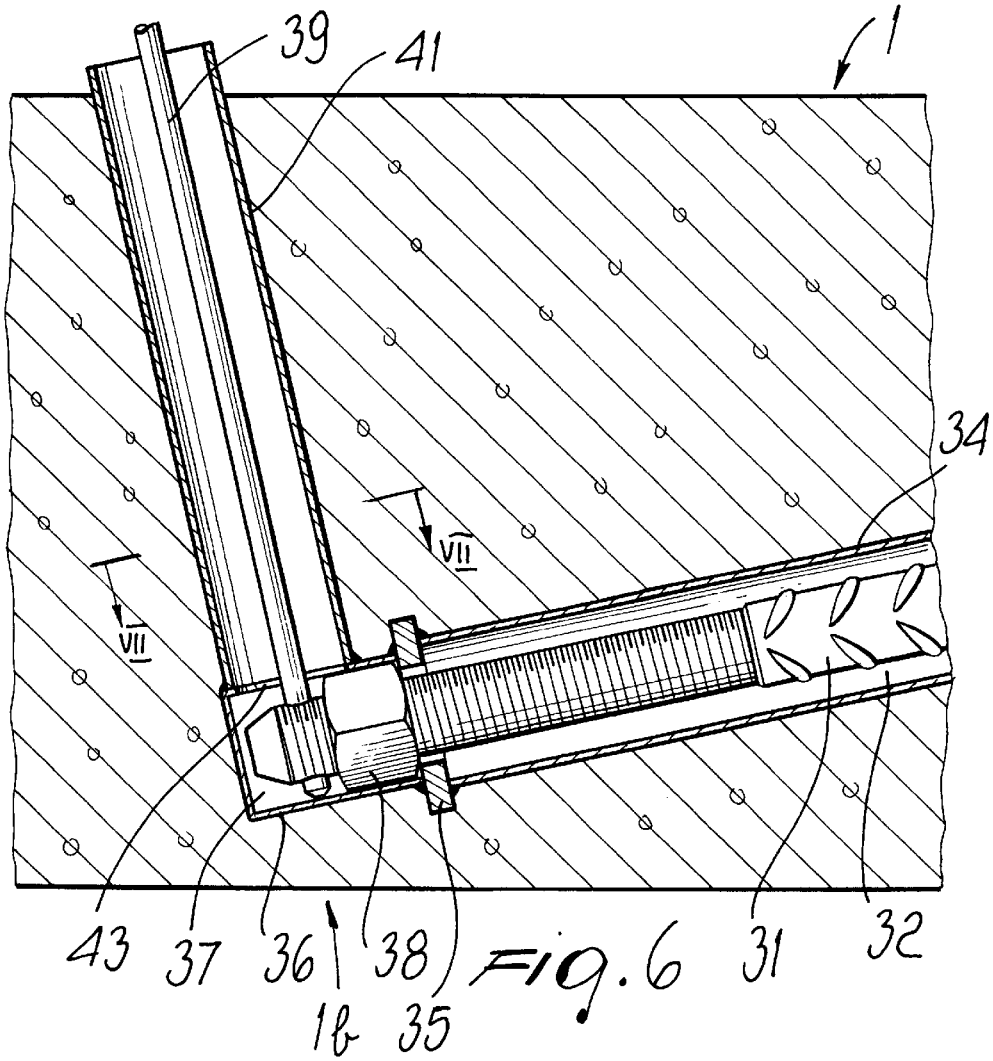
FIG. 6 is an enlarged-scale view of a detail of FIG. 4.
Figure 7:
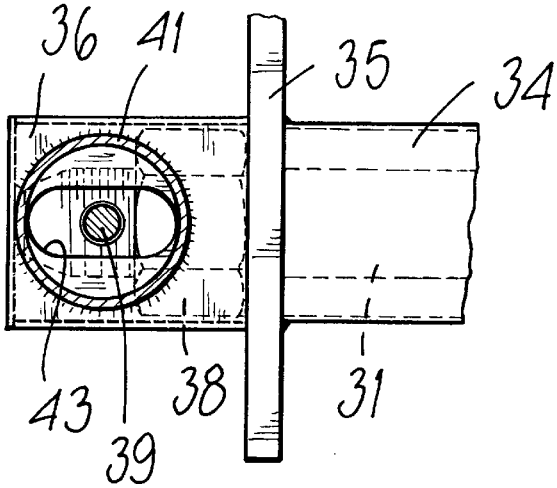
FIG. 7 is a sectional view of FIG. 6 taken along the line VII—VII, with the concrete omitted for the sake of clarity.
Figure 8:
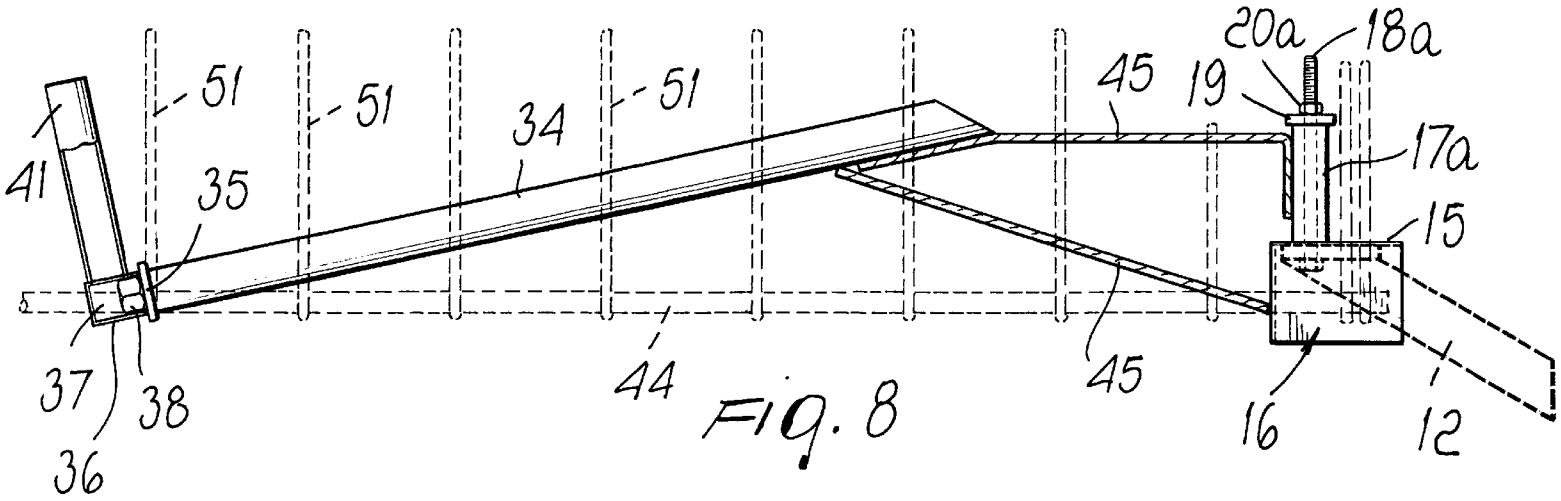
FIG. 8 is a side elevation view of the part of the device to be embedded in the beam.
Figure 9:
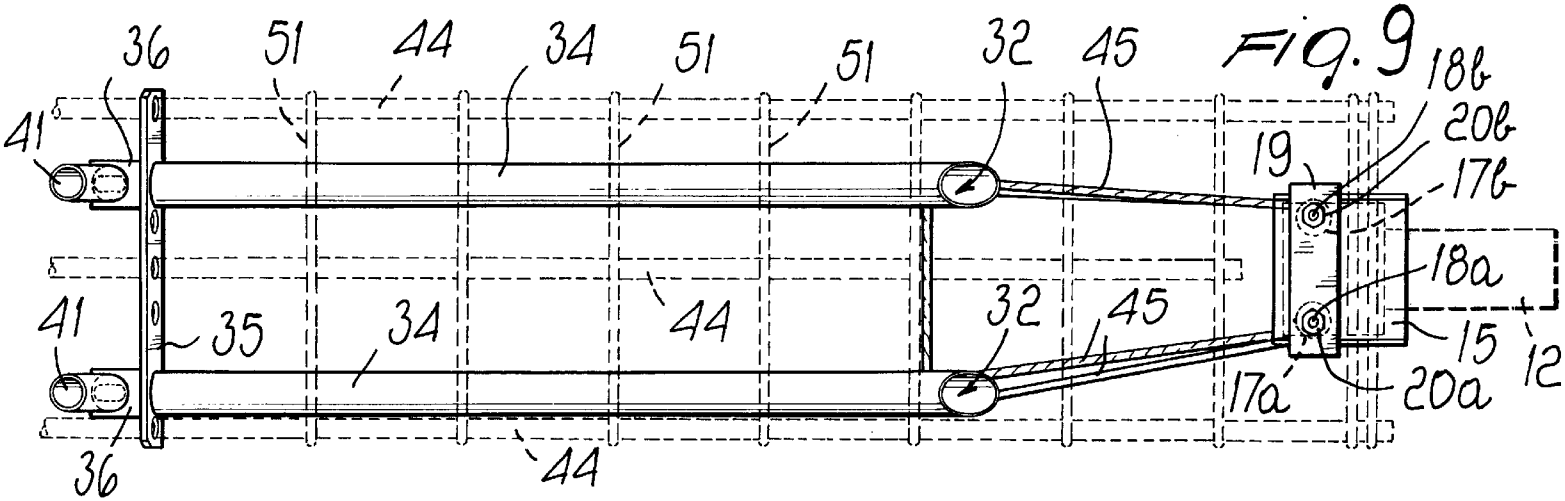
FIG. 9 is a top plan view of the part of the device to be embedded in the beam.
Figure 11:
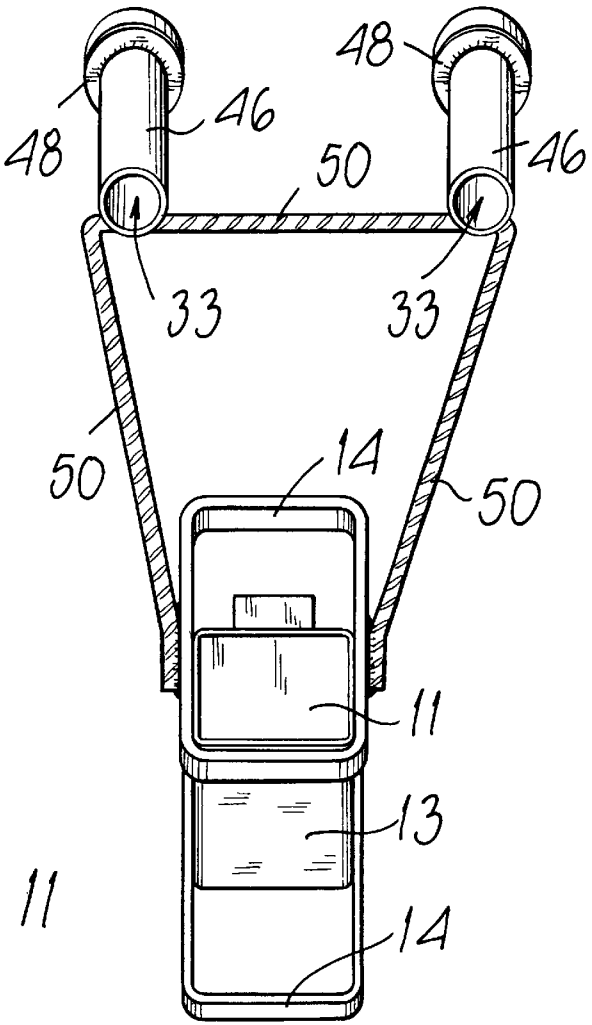
FIG. 11 is a top plan view of the part of the device to be embedded in the pillar.
Figure 10:
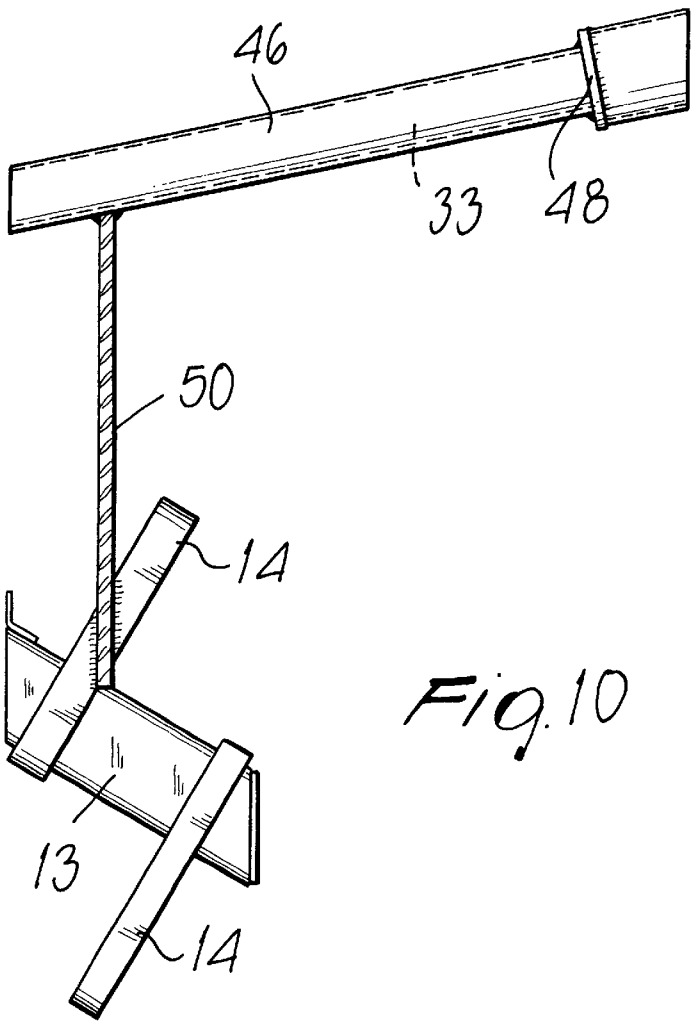
FIG. 10 is a side elevation view of the part of the device to be embedded in the pillar.

If the pillar 2 must support beams 1 on its two opposite sides, or in any case on two or more sides, a plurality of tubular bodies 46 with various orientations, so as to receive the various ties 31 connected to the various beams 1 supported by the pillar 2, and various box-like bodies 13 for brackets 12 are embedded in the body of the pillar as shown in FIG. 1 and more particularly in FIG. 5.

For the sake of completeness in description, it should be noted that the reinforcement frame of the beam is completed by transverse bars 51.

The assembly of the device according to the invention is as follows.

The beam 1 is rested on the brackets 12 that protrude from the two pillars 2 which must support the beam 1 and is fixed to them by bolting, as described, providing two interlocking connections between the ends of the beam 1 and the pillars 2. The ties 31 are then inserted through the corresponding tubular bodies 46 and 34, locking, by screwing and optionally by means of the pin 39, one end of the ties 31 in the beam 1.

By tightening the nut 47 on the other end of the ties 31, two intermediate regions 1*b* of the beam 1 are connected to the pillars 2 by means of the ties 31.

The tightening of the nut 47 on the ties 31 also allows to tension the ties 31 so as to preload in an upward direction the beam 1, achieving an effect which is similar to prestress and therefore giving the beam 1 greater resistance to the loads that it will have to bear. In this manner it is possible to provide beams 1 which, for an equal load resistance with beams which are simply rested on the pillars 2, can have significantly reduced vertical dimensions.

It is thus possible to use without problems prefabricated beams and pillars even in the construction of office or residential buildings, in which the need to have reduced-height beams is particularly felt.

Important advantages with respect to the on-site construction method are thus achieved. First of all, advantages in terms of speed and low cost of construction and all the advantages that are typical of building with prefabricated components.

The following advantages are also achieved with the device according to the invention:

- the connection between the beam and the pillar can be provided even without having to perform welding during the installation of the components;
- the pillars can be produced without protrusions, thus reducing the production costs of said pillars and simplifying assembly in multi-story buildings;
- during installation, it is extremely simple to inspect the correct execution of the beam-pillar connections before performing the concrete castings to form the slabs;
- the ties are connected to the main reinforcement frame in the tensioned region of the beam, increasing the strength and safety of the entire building;
- high earthquake-resistance of the building.

As to this last advantage, it should be noted that the device according to the invention achieves high earthquake-resistance even during building, due to the particular connection between the beams and the pillars provided by the device.

A further advantage of the device according to the invention is that it allows to also reduce the reinforcement frame of the beam.

In practice it has been observed that the device according to the invention fully achieves the intended aim and objects, since by allowing to reduce the height of the beam it allows to use prefabricated concrete components even in sectors in which up to now the prefabrication technique was not applied or was applied to a minimal extent.

Although the illustrated embodiment is preferred, the device according to the invention is susceptible of numerous modifications and variations; thus, for example, the tensioning of the ties 31, instead of being performed at the end of the ties 31 that is connected to the pillars 2, can be provided by forming each tie 31 in two segments which are connected one another by a tensioning bush in the region of the tie 31 that lies between the corresponding pillar 2 and the beam 1. Moreover, the end of the ties 31 that is connected to the beam 1, instead of being connected to the inside of the beam, can be connected to the lower side of the beam and optionally can be fixed to the beam by welding or by way of connecting elements which are different from the ones shown. Optionally, the ties 31 that connect the pillars 2 to the beam 1 can also be connected to the upper side of the beam 1 and to the side of the pillars 2 that is directed toward the beam 1. The interlocking connection between the beam 1 and the pillars 2 also can be provided by means of other conventional connection elements which are in any case capable of providing a connection of the interlocking type between the pillars 2 and the beam 1.

In practice, the materials employed, as well as the dimensions, may be any according to requirements and to the state of the art.

The disclosures in Italian Patent Application No. MI99A002129 from which this application claims priority are incorporated herein by reference.

What is claimed is:

1. A device for connecting a beam to load-bearing structural pillar elements, for constructing buildings, particularly multi-story buildings, by way of prefabricated concrete components, comprising: first connection means for connecting two end regions of the beam to the pillar elements; and second connection means for connecting two intermediate regions of a longitudinal extension of the beam to the pillar elements, said first connection means being constituted by connection means of the interlocking type, and said second connection means comprising at least two rigid inclined ties, each of which connecting a said intermediate region of the beam to a region of a respective pillar element which lies at a higher level than the region where the tie is coupled to the beam, said region of the respective pillar element being also at a higher level than an upper edge of said beam, in order to obtain at least four connection points between said beam and said pillar.

2. The device of claim 1, wherein said ties are embedded in a concrete casting of a slab performed above said beam.

3. The device of claim 1, wherein said first connecting means comprise: a cavity which is formed, for each end region of the beam, in the body of the respective said pillar element, said cavity being open on a side of said pillar element that is directed toward said beam; and a bracket which protrudes from said side of the pillar element and is fixed to said beam.

4. The device of claim 3, wherein said cavity is formed by a box-like body which is embedded in said pillar element.

5. The device of claim 4, wherein said bracket protrudes from said side of the pillar element and forms a support for the end regions of said beam, said bracket being rigidly fixed to said beam.

6. The device of claim 5, wherein said cavity and said bracket are inclined upward toward said beam.

7. The device of claim 6, wherein said bracket is fixed to said beam by bolting.

8. The device of claim 6, comprising a tie passage, formed in said beam, in order to arrange a region where the tie is coupled to said beam proximate to a lower side of the beam.

9. The device of claim 8, comprising a further tie passage, which connects said beam to said pillar, and is formed in said pillar element.

10. The device of claim 9, wherein said tie passage and further tie passage are formed by tubular bodies which are embedded in said beam and in said pillar element.

11. The device of claim 10, comprising tensioning means for tensioning said tie.

12. The device of claim 11, wherein each said tie has an end, which is fixed to said beam, and a further end, which is constituted by a threaded portion, said tensioning means comprising a nut which abuts against said pillar element and is actuatable for tie tensioning.

13. The device of claim 12, comprising a female thread provided in said tie passage formed in said beam, the end of said tie that is fixed to said beam being threaded and engaging said female thread.

14. The device of claim 13, further comprising a pin which interferes with the end of the tie for locking said tie end in said beam; a tubular body, for accommodating said pin, which intersects the tie passage formed in the beam, said tubular body that accommodates said pin being open at one of its axial ends in order to allow insertion of said pin.

15. The device of claim 14, wherein said box-like body and said tubular body embedded in the body of the pillar element are rigidly connected to each other.

16. The device of claim 15, comprising a plate which is embedded in said beam and is connected to a reinforcement frame of the beam, the tubular body embedded in said beam for the passage of said tie being rigidly fixed to said plate.

17. The device of claim 16, wherein said beam has, at its end to be directed toward said pillar element, a lower recess for resting said bracket.

18. The device of claim 17, wherein said recess is formed by said plate which is embedded in the body of said beam and is rigidly connected to the tubular body that forms the passage for said tie and is embedded in said beam.

19. A device for connecting a beam to load-bearing structural pillar elements, for constructing buildings, particularly multi-story buildings, by way of prefabricated concrete components, comprising: first connection means for connecting two end regions of the beam to the pillar elements; and second connection means for connecting two intermediate regions of a longitudinal extension of the beam to the pillar elements, said first connection means being constituted by connection means of the interlocking type, and said second connection means comprising at least two rigid inclined ties, each of which connecting a said intermediate region of the beam to a region of a respective pillar element which lies at a higher level than the region where the tie is coupled to the beam, and wherein said ties are embedded in a concrete casting of a slab performed above said beam.

20. The device of claim 19, wherein said first connecting means comprise: a cavity which is formed, for each end region of the beam, in the body of the respective said pillar element, said cavity being open on a side of said pillar element that is directed toward said beam; and a bracket which protrudes from said side of the pillar element and is fixed to said beam.

21. The device of claim 20, wherein said cavity is formed by a box-like body which is embedded in said pillar element.

22. The device of claim 21, wherein said bracket protrudes from said side of the pillar element and forms a support for the end regions of said beam, said bracket being rigidly fixed to said beam.

23. The device of claim 20, wherein said cavity and said bracket are inclined upward toward said beam.

24. The device of claim 20, wherein said bracket is fixed to said beam by bolting.

25. The device of claim 19, comprising a tie passage, formed in said beam, in order to arrange a region where the tie is coupled to said beam proximate to a lower side of the beam.

26. The device of claim 25, comprising a further tie passage, which connects said beam to said pillar, and is formed in said pillar element.

27. The device of claim 26, wherein said tie passage and further tie passage are formed by tubular bodies which are embedded in said beam and in said pillar element.

28. The device of claim 19, comprising tensioning means for tensioning said tie.

29. The device of claim 28, wherein each said tie has an end, which is fixed to said beam, and a further end, which is constituted by a threaded portion, said tensioning means comprising a nut which abuts against said pillar element and is actuatable for tie tensioning.

30. The device of claim 25, comprising a female thread provided in said tie passage formed in said beam, the end of said tie that is fixed to said beam being threaded and engaging said female thread.

31. The device of claim 25, further comprising a pin which interferes with the end of the tie for locking said tie end in said beam; a tubular body, for accommodating said pin, which intersects the tie passage formed in the beam, said tubular body that accommodates said pin being open at one of its axial ends in order to allow insertion of said pin.

32. The device of claim 31, wherein said box-like body and said tubular body embedded in the body of the pillar element are rigidly connected to each other.

33. The device of claim 31, comprising a plate which is embedded in said beam and is connected to a reinforcement frame of the beam, the tubular body embedded in said beam for the passage of said tie being rigidly fixed to said plate.

34. The device of claim 20, wherein said beam has, at its end to be directed toward said pillar element, a lower recess for resting said bracket.

35. The device of claim 33, wherein said recess is formed by said plate which is embedded in the body of said beam and is rigidly connected to the tubular body that forms the passage for said tie and is embedded in said beam.

36. A device for connecting a beam to load-bearing structural pillar elements, for constructing buildings, particularly multi-story buildings, by way of prefabricated concrete components, comprising: first connection means for connecting two end regions of the beam to the pillar elements; and second connection means for connecting two intermediate regions of a longitudinal extension of the beam to the pillar elements, said first connection means being constituted by connection means of the interlocking type, and said second connection means comprising at least two rigid inclined ties, each of which connecting a said intermediate region of the beam to a region of a respective pillar element which lies at a higher level than the region where the tie is coupled to the beam, wherein said first connecting means comprise: a cavity which is formed, for each end region of the beam, in the body of the respective said pillar element, said cavity being open on a side of said pillar element that is directed toward said beam; and a bracket which protrudes from said side of the pillar element and is fixed to said beam.

37. The device of claim 36, wherein said ties are embedded in a concrete casting of a slab performed above said beam.

38. The device of claim 36, wherein said cavity is formed by a box-like body which is embedded in said pillar element.

39. The device of claim 36, wherein said bracket protrudes from said side of the pillar element and forms a support for the end regions of said beam, said bracket being rigidly fixed to said beam.

40. The device of claim 36, wherein said cavity and said bracket are inclined upward toward said beam.

41. The device of claim 36, wherein said bracket is fixed to said beam by bolting.

42. The device of claim 36, comprising a tie passage, formed in said beam, in order to arrange a region where the tie is coupled to said beam proximate to a lower side of the beam.

43. The device of claim 42, comprising a further tie passage, which connects said beam to said pillar, and is formed in said pillar element.

44. The device of claim 43, wherein said tie passage and further tie passage are formed by tubular bodies which are embedded in said beam and in said pillar element.

45. The device of claim 36, comprising tensioning means for tensioning said tie.

46. The device of claim 45, wherein each said tie has an end, which is fixed to said beam, and a further end, which is constituted by a threaded portion, said tensioning means comprising a nut which abuts against said pillar element and is actuatable for tie tensioning.

47. The device of claim 42, comprising a female thread provided in said tie passage formed in said beam, the end of said tie that is fixed to said beam being threaded and engaging said female thread.

48. The device of claim 42, further comprising a pin which interferes with the end of the tie for locking said tie end in said beam; a tubular body, for accommodating said pin, which intersects the tie passage formed in the beam, said tubular body that accommodates said pin being open at one of its axial ends in order to allow insertion of said pin.

49. The device of claim 48, wherein said box-like body and said tubular body embedded in the body of the pillar element are rigidly connected to each other.

50. The device of claim 48, comprising a plate which is embedded in said beam and is connected to a reinforcement frame of the beam, the tubular body embedded in said beam for the passage of said tie being rigidly fixed to said plate.

51. The device of claim 36, wherein said beam has, at its end to be directed toward said pillar element, a lower recess for resting said bracket.

52. The device of claim 51, wherein said recess is formed by said plate which is embedded in the body of said beam and is rigidly connected to the tubular body that forms the passage for said tie and is embedded in said beam.

* * * * *